US005233903A

United States Patent [19]

Saphier et al.

[11] Patent Number: 5,233,903

[45] Date of Patent: Aug. 10, 1993

[54] GUN WITH COMBINED OPERATION BY CHEMICAL PROPELLANT AND PLASMA

[75] Inventors: David Saphier; Shlomo Wald; Joseph Ashkenazi; Zvi Kaplan, all of Rehovot; Boaz Brill, Rishon Lezion, all of Israel

[73] Assignee: The State Of Israel, Atomic Energy Commission, Soreq Nuclear Research Center, Israel

[21] Appl. No.: 894,273

[22] Filed: Jun. 4, 1992

Related U.S. Application Data

[63] Continuation of Ser. No. 475,182, Feb. 5, 1990, abandoned.

[30] Foreign Application Priority Data

Feb. 9, 1989 [IL] Israel ..... 89231

[51] Int. Cl.[5] ..... F41B 6/00

[52] U.S. Cl. ..... 89/8; 89/7

[58] Field of Search ..... 89/7, 8; 102/202.5; 124/3

[56] References Cited

U.S. PATENT DOCUMENTS

| | | | |
|---|---|---|---|
| 1,298,447 | 3/1919 | Bradford | 89/8 |
| 2,360,217 | 10/1944 | Francis | 42/76 |
| 2,783,684 | 3/1957 | Yoler | 89/7 |
| 2,790,354 | 4/1957 | Yoler et al. | 89/8 |
| 3,044,363 | 7/1962 | Musser | 89/8 |
| 3,357,306 | 12/1967 | Boyd et al. | 89/8 |
| 3,459,101 | 8/1969 | Scanlon et al. | 89/8 |
| 3,613,499 | 10/1971 | Hubbard et al. | 89/8 |
| 3,736,837 | 6/1973 | Kaprelian et al. | 89/28.05 |
| 3,916,761 | 11/1975 | Fletcher et al. | 89/8 |
| 4,343,233 | 8/1982 | Burgin | 100/116 |
| 4,467,696 | 8/1984 | McNab et al. | 89/8 |
| 4,485,720 | 12/1984 | Kemeny | 89/8 |
| 4,577,545 | 3/1986 | Kemeny | 89/8 |
| 4,590,842 | 5/1986 | Goldstein et al. | 89/8 |
| 4,621,577 | 11/1986 | Bickes et al. | 102/200 |
| 4,621,599 | 11/1986 | Igashira et al. | 123/300 |
| 4,640,180 | 2/1987 | Rose | 89/8 |
| 4,711,154 | 12/1987 | Chryssomallis et al. | 89/7 |
| 4,715,261 | 12/1987 | Goldstein et al. | 89/8 |
| 4,895,062 | 1/1990 | Chryssomallis et al. | 89/7 |
| 4,974,487 | 12/1990 | Goldstein et al. | 89/7 |
| 5,012,719 | 5/1991 | Goldstein et al. | 89/8 |
| 5,016,518 | 5/1991 | Kaplan | 89/8 |

FOREIGN PATENT DOCUMENTS

| | | | |
|---|---|---|---|
| 0232594 | 8/1987 | European Pat. Off. . | |
| 3601394 | 7/1987 | Fed. Rep. of Germany | 102/202.5 |

OTHER PUBLICATIONS

The Illustrated Science and Invention Encyclopedia, "The V3", 1977, pp. 1408–1409.

*Primary Examiner*—Stephen C. Bentley

*Attorney, Agent, or Firm*—Steinberg & Raskin

[57] ABSTRACT

A hybrid gun for launching a projectile by a combined propulsion effect of a chemical propellant and electrothermal energy. The gun comprises a breech-associated electrothermal propulsion energy injector having a plasma beam generator and a tubular chamber holding a light working fluid that during the travel of the projectile in the barrel produces at the rear of the projectile a light gaseous buffer zone. Optionally the gun may have in addition one or more electrothermal propulsion energy injectors mounted on the barrel.

There is also provided ammunition for use with a hybrid gun having a chemical propellant holding cartridge designed for ignition by working fluid injected by the breech associated electrothermal propulsion energy injector.

9 Claims, 4 Drawing Sheets

GUN WITH COMBINED OPERATION BY CHEMICAL PROPELLANT AND PLASMA

This is a continuation of application Ser. No. 07/475,182, filed Feb. 5, 1990, now abandoned.

FIELD OF THE INVENTION

This invention relates to so-called hypervelocity guns, i.e. guns capable of firing projectiles at muzzle velocities in excess of 1500 and up to 4000 m/sec., i.e. velocities which are generally beyond the capabilities of conventional guns. By imparting to gun fired projectiles hypervelocities their performance is improved in terms of range, penetration power and accuracy.

BACKGROUND OF THE INVENTION AND PRIOR ART

Conventionally, projectiles are accelerated within the barrel by the action of a so-called chemical propellant, i.e. by propulsion gases generated by the rapid combustion of chemical propellants. However the muzzle velocity of these projectiles will usually be below 1500 m/sec. which is due to the low sound speed in the combustion gases. With some type of known chemical propellant ammunition it is possible to reach muzzle velocities of up to 2000 m/sec. but this requires relatively large quantities of propellant per projectile and gives rise to considerable stresses in the breech and barrel.

With the ignition of a chemical propellant the combustion process is started and the gaseous products are produced at a rate of w defined by $$w = AbP^{\alpha} \quad \text{(I)}$$

where A is the surface area of the propellant, P is the pressure within the gun chamber and b and $\alpha$ are burning coefficients specific to each type of propellant. When the force on the projectile base becomes larger than the static friction and the engraving forces, the projectile starts moving and the volume in which the gas expands increases. This increase of volume results in a general decrease of the average pressure $P_{av}$ in the barrel after a certain maximum is reached. The pressure $P_b$ behind the advancing projectile is further reduced to values lower than $P_{av}$ due to the gas rarefaction behind the "escaping projectile". The pressure $P_b$ acting on the moving projectile base is determined approximately by the equation $$P_b = P_{av}\left\{1 + \frac{\gamma - 1}{2\phi} M^2\right\}^{\frac{-\gamma}{(\gamma-1)}} \quad \text{(II)}$$

where $\gamma$ is the ratio cp/cv of the propellant gases specific heats at constant pressure and constant volume, respectively, M is the Mach number of the projectile with relation to the propelling gas and $\phi$ is an experimental constant usually in the range of 1.5. It follows from equation (II) that the higher the projectile velocity the lower the $P_{av}$ to $P_b$ ratio and the pressure exerted on the projectile base decreases faster for high velocity guns than for low velocity guns. Consequently, the rate of acceleration in high velocity guns decreases faster than in low velocity guns and so does their thermal efficiency.

In order to overcome the intrinsic limitation of chemical propellants, several guns have been proposed which are characterized by supplementing the initial propulsion from the propellant ignited at the breech by a plurality of successively acting booster propulsions brought about by additional chemical propellant charges mounted along the barrel and adapted to be initiated by the passing projectile. Arrangements of this type are described, for example in U.S. Pat. Nos. 2,360,217; 3,044,363; 3,357,306; 3,459,101 and 3,613,499.

By using this technique it is possible to obtain higher velocities due to the additive actions of the initial and booster charges. Nevertheless, these guns have not enjoyed widespread use, mainly owing to the difficulty of accomplishing the required control of the burning of the booster charges along the barrel.

Another technique to accelerate projectiles to hypervelocity is the use of highly pressurized light gases, "the light gas cannon". The light gas cannon too did not develop beyond the experimental stage.

Various proposals are known for the acceleration of projectiles by means of electrothermal energy. Thus, for example U.S. Pat. Nos. 2,783,684 and 2,790,354 describe methods and means for accelerating a projectile within a gun's barrel by generating high pressure waves which accelerate the projectile down the length of the tube. The high pressure is maintained by means of electric arcs generated within the tube via high voltage electrodes spaced along the length of the tube, so that the electric arcs will continuously be generated as the projectile travels down the tube.

By way of a further development of the concept of accelerating projectiles by means of electrothermal energy, the use of plasma has repeatedly been proposed such as in U.S. Pat. Nos. 3,916,761, 4,590,842, EP-A2-0232594 and U.S. Pat. No. 4,715,261. In accordance with all these proposals chemical propellants are replaced by a plasma, or a gas heated by plasma acting on the rear of the projectile. The major limitation for practical application of the known plasma propellant is the very large and cumbersome electrical power supply that is associated therewith.

There are also known so-called magnetic rail gun accelerators with plasma propellants as disclosed for example in U.S. Pat. Nos. 4,343,223; 4,467,696; 4,485,720; 4,577,545 and 4,621,577.

In our U.S. Pat. No. 5,016,518, issued May 21, 1991, we are describing for the first time a gun for accelerating projectiles in which the travelling chemical charges are ignited by electrothermal energy sources. By one mode disclosed in that patent application there are provided electrothermal energy injectors along the gun barrel which are fired synchronously with the displacement of the projectile within the barrel, each such injector igniting a distinct chemical propellant charge attached to the projectile. Essentially that mode of the gun of our U.S. Pat. No. 5,016,518, issued May 21, 1991, operates by the travelling charge principle in which the boosting of the thrust on the projectile is brought about by successively ignited propellant charges attached to the projectile itself while the electrothermal energy injectors on the barrel serve for ignition only.

Our U.S. Pat. No. 5,016,518, issued May 21, 1991, further describes an alternative method by which a plasma injector unit is mounted at the rear of the gun coaxially with the barrel and the injected plasma acts via a working fluid to initiates the chemical propellant.

It is the object of the present invention to provide an improved gun in which high muzzle velocities can be reached and which is expected to perform better than the various known guns based on chemical and/or electrothermal acceleration.

BRIEF DESCRIPTION OF THE INVENTION

Broadly speaking the present invention enables to utilize to the utmost the energy stored in a chemical propellant with the addition of only a minimum amount of electrical energy to drive the projectile into hypervelocity. The improvement with respect to pure chemical propulsion is the significant increase of the muzzle velocity, while with respect to a pure electrothermal energy gun, there is achieved a significant reduction of the size of the electrical power supply. The invention thus provides a new and effective way to achieve hypervelocity.

In accordance with the present invention, it has been found that the muzzle velocity of a projectile can be significantly increased as compared to conventional guns, by combining the conventional combustion of a propellant with the injection of electrothermal energy in a controlled manner to obtain a hybrid system which will be referred to herein as the "hybrid gun".

The performance of a hybrid gun according to the invention is characterized by the following:

a) the pressure in the barrel increases to the maximum permissible design values as fast as is technically feasible;

b) the maximum pressure is maintained for a prolonged period of time;

c) the ratio of base pressure to average pressure is increased by maintaining an energized light gas buffer zone between the projectile base and the expanding propellant gases, whereby the efficiency of the acceleration process is increased.

In consequence of all this the desired muzzle hypervelocity is attained.

The energized light gas buffer zone is confined to a volume behind the projectile. Consequently, there will be less rarefaction at the front of the expanding propellant and more of its energy will be transmitted to the projectile via the light gas buffer zone, imparting a higher velocity to the projectile.

The hybridization concept according to the invention is new and to the best of applicants' knowledge, is proposed herein for the first time.

By one aspect the invention provides a gun for launching a chemical propellant bearing projectile having a barrel and breech as known per se, characterized by being a hybrid gun which launches said chemical propellant bearing projectile by a combined propulsion effect produced by said chemical propellant and by electrothermal energy, and further characterised by breech-associated electrothermal propulsion energy injector means located to the rear of the breech and comprising a plasma jet generator and intermediary thereof and the breech an aligned tubular chamber having a nozzle opening into the breech and holding a light working fluid having a molecular weight not exceeding that of said chemical propellant; and electric starter means for the pulsating successive energization of said breech-associated electrothermal propulsion energy injector means whereby the injector means eject desired jets of activated gaseous light working fluid into a chemical propellant holding cartridge of said chemical propellant bearing projectile.

In operation, each time the plasma jet generator of the breech-associated electrothermal energy injector means produces a plasma pulse, a jet of activated gaseous light working fluid is injected in the direction of a round of ammunition loaded into the breech. The invention requires that the so injected light working fluid reaches the base of the projectile. To this end specially designed ammunition is required in which the cartridge comprises a central perforated tube surrounded by the propellant charge and preferably lined with an ablative material such as plastic material that upon heating releases a light gaseous phase which combines with the injected light gaseous phase. Due to the perforations in the said central tube of the cartridge, the propellant charge is ignited by the injected hot gas jet.

Thus, by another aspect the invention also provides ammunition for use with a hybrid gun of the kind specified, comprising a projectile and a chemical propellant holding cartridge having an axially extending, hollow, perforated tube open at the cartridge base and leading to the projectile base.

The propellant in such ammunition is of a kind known per se and is selected so as to avoid excessive pressure in the barrel. Such selection is readily performed by persons skilled in the art by selection of a propellant with an adequate chemical composition, by the incorporation of a retardant and by a judicious selection of the geometry of the pellets.

In accordance with the invention it is possible to convert an ordinary gun into a hybrid gun by providing at the rear of the breech an electrothermal propulsion energy injector comprising in mutual alignment a plasma jet generator and a tubular chamber fitted with an injection nozzle and holding a working fluid having a molecular weight not exceeding that of the chemical propellant of the designated ammunition.

Accordingly, by a still further aspect the invention provides a method of converting a conventional gun into a hybrid gun according to the invention specified by fitting such conventional gun with a breech-associated electrothermal propulsion energy injector specified. Due to this aspect of the invention a conventional barrel with given technological constraints such as maximum pressure and length can be retrofitted to fire a projectile at a much higher velocity.

Yet another aspect the invention provides for use with a hybrid gun of the kind specified, an electrothermal energy injector device comprising in mutual alignment a plasma jet generator and a tubular chamber fitted with an injection nozzle and holding a working fluid having a molecular weight not exceeding that of the propellant in the designated ammunition.

In accordance with one embodiment, a hybrid gun according to the invention comprises only a breech-associated electrothermal propulsion energy injector.

In accordance with another embodiment the hybrid gun according to the invention has in addition at least one barrel-associated electrothermal propulsion energy injector mounted on the barrel and comprising a plasma jet injector and intermediary thereof and the barrel an aligned tubular chamber having a nozzle opening into the barrel and holding a working fluid having a molecular weight not exceeding that of the chemical propellant of the designated ammunition. Preferably, the barrel-associated electrothermal propulsion energy injectors are arranged pairwise with each pair being mounted in axi-symmetrical configuration with respect to the longitudinal axis of the barrel. By one modification of this embodiment there is provided one single pair of barrel-associated electrothermal propulsion energy injectors while by another modification the gun comprises several pairs of barrel-associated electrothermal propulsion energy injectors spaced from each other.

When a conventional gun is converted into a hybrid gun according to the invention by fitting it with a breech-associated electrothermal propulsion energy injector it is also possible to fit it with a barrel having at least one electrothermal propulsion energy injector mounted thereon.

Upon energization of an electrothermal propulsion energy injector, a plasma jet is produced which energizes some working fluid and a gust of activated working fluid is ejected therefrom in form of a jet and is injected into the breech or the barrel, as the case may be. The electric starter means, which are known per se, are designed to produce a cycle of successive energizations of the various electrothermal propulsion energy injectors for each round of ammunition. If desired, the electric starter means may be designed to induce the formation of two or even three successive activated working fluid jets by the breech-associated injector before the first barrel-associated injector is energized.

In the hybrid-type gun according to the invention, the breech-associated electrothermal propulsion energy injector injects activated working fluid into the breech and also serves as an ignition device for the chemical propellant. However, beyond mere ignition, the activated working fluid injected into the breech interacts with the propellant gases generated upon ignition of the chemical propellant to increase the pressure at a rate faster than in conventional guns so that the maximum gun-permissible pressure acting on the rear of the projectile is reached faster.

When the projectile base passes the nozzles of a barrel-associated electrothermal propulsion energy injector such injector is activated by means of an optical or other type sensor whereby energized working fluid is injected into the barrel. The injected light gaseous working fluid forms a buffer layer with a higher sound velocity than the chemical propellant and therefore provides an efficient means to transfer its energy and the energy of the expanding propellant to the projectile and to impart to the projectile the required kinetic energy.

It has been found that in a hybrid gun according to the invention, the average barrel pressure remains at its maximum for a relatively long period of time and that furthermore, the increment between the average barrel pressure and the projectile base pressure is reduced. As a result of all this, the projectile can be accelerated into hypervelocity, i.e., velocities between 1500–4000 m/sec. according to the desired application, the lower range serving, for example, for artillery and armour penetration missiles and the higher range for anti-ballistic missiles.

DESCRIPTION OF THE DRAWINGS

The invention will now be particular described with reference to the annexed drawings in which.

DESCRIPTION OF A SPECIFIC EMBODIMENT

Figure 1:
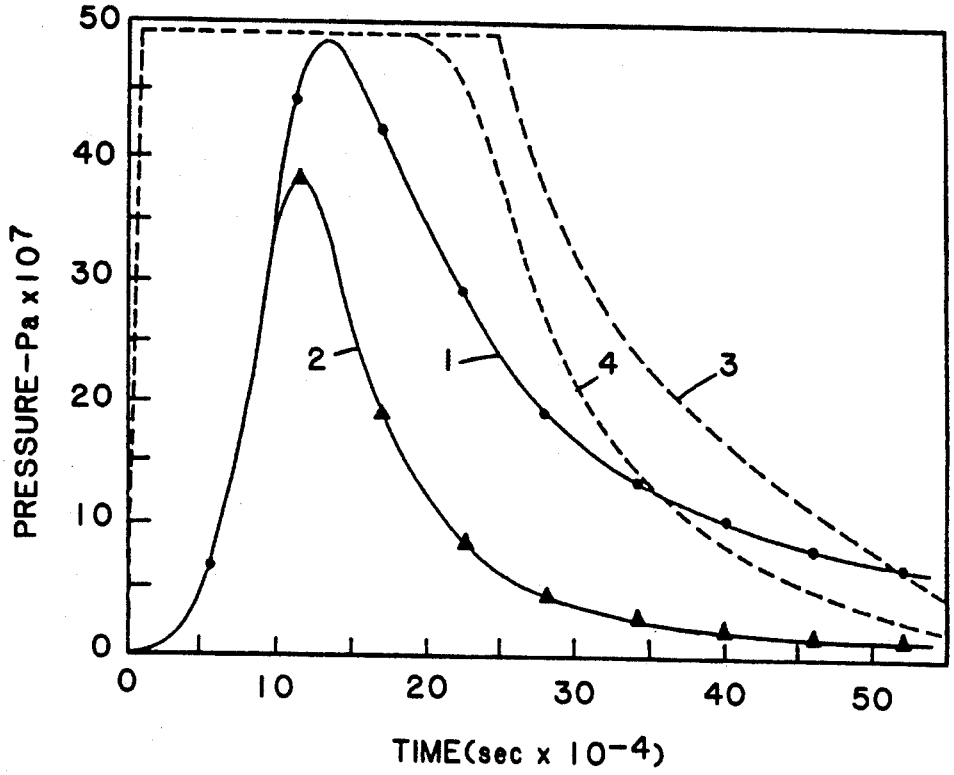
FIG. 1 is a graphical representation showing the average and projectile base pressure profiles vs. time of a high velocity conventional gun with chemical propulsion and the potential that can be achieved with a hybrid gun according to the invention.

In FIG. 1 the pressure inside the barrel of a gun is plotted vs. the time counted from firing. The first curve 1 shows the average pressure profile in a conventional high velocity gun in which the projectile is accelerated by expanding gases generated by a combusting chemical propellant. This curve is characteristic of the interior ballistics of all conventional guns in the case shown a maximum pressure of 500 MPa is reached after 1.5 m/s.

The second curve 2 in FIG. 1 shows the pressure acting on the projectile base and it is seen that as the projectile velocity increases the pressure acting on the projectile base decreases according to equation (II) herein and is significantly smaller than the average pressure in the barrel.

Curves 3 and 4 show the pressure potential that can be achieved in a hybrid gun of the present invention, mainly that the maximum average pressure can be maintained for a longer period of time, and consequently, the pressure exerted on the projectile base (curve 4) is higher and the $P_b/P_{av}$ ratio is much higher than in the conventional gun.

It is readily understood by a person skilled in the art that with the lengths and diameters being equal, the pressure profile in a hybrid gun according to the invention ensures better performance and a higher muzzle velocity than can be achieved with a conventional gun.

It can moreover be shown that the performance of a hybrid gun according to the invention is also superior to a gun with the same length and diameter with exclusive plasma propulsion, since in the hybrid gun only a fraction of the propulsion energy has to be supplied as electrical energy. Consequently a hybrid gun according to the invention can be made practical for many applications since it does not require large cumbersome electrical power sources.

The manner in which the pressure profile of a hybrid gun according to the invention as shown in an idealized form by way of curve 2 in FIG. 1 can be achieved in reality, will now be explained.

In accordance with the invention there occurs a synergistic effect between the expanding propellant gases resulting from the combustion of the chemical propellant, and a plasma activated working fluid. In order to achieve the desired result in terms of pressure profile within the barrel, at least three electrothermal injections are required. These injections can be delivered either by the breech-associated injector, or by one or more barred-associated injectors. As mentioned, the barrel-associated injectors are preferably arranged in paris with each such pair being mounted in an axi-symmetrical configuration. In many cases one such pair located close to the breech region will be sufficient. In case of guns with long barrels two or more pairs of injectors suitably spaced from each other may be desired.

Figure 2:
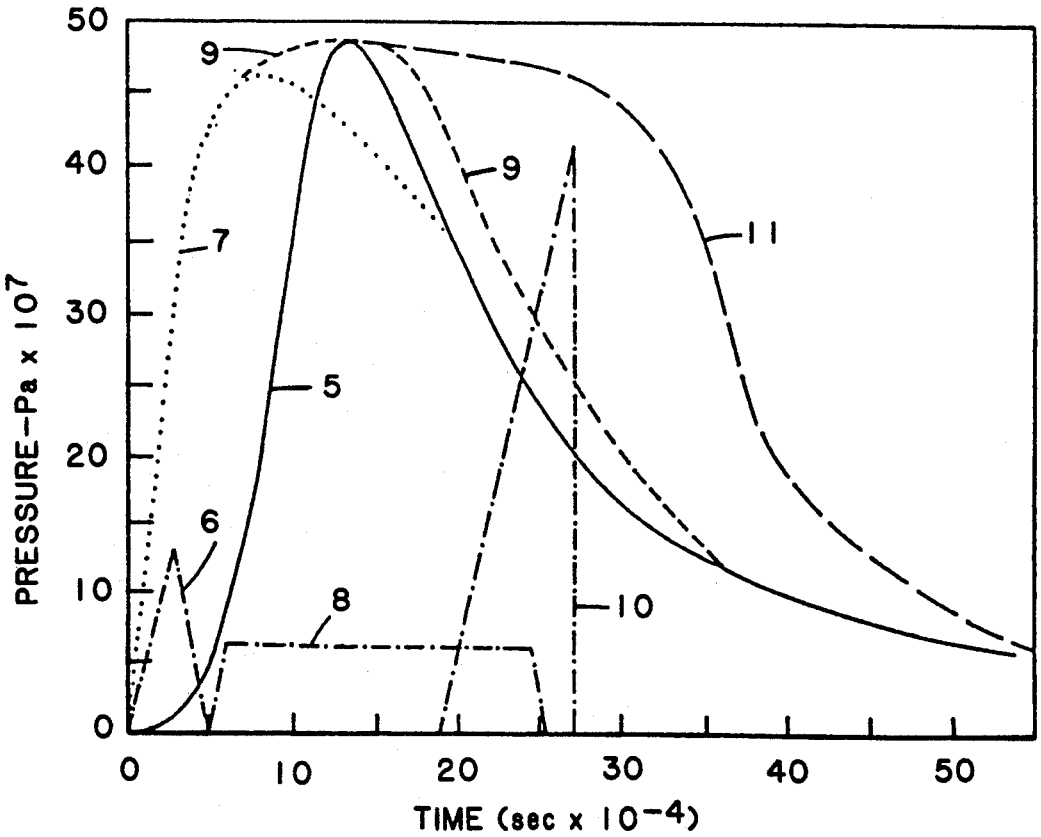
FIG. 2 is a graphical representation showing the calculated performance and design characteristics of a hybrid gun according to the invention showing the barrel average pressure resulting from each of the electrothermal energy pulses and the burning propellant.

Attention is not directed to FIG. 2 in which curve 5 is the normal average pressure profile in a conventional gun with chemical propulsion and it is identical to curve 1 in FIG. 1. In a hybrid gun according to the invention the normal ignition by means of a percussion fuse is replaced by plasma ignition by means of the breech-associated electrothermal propulsion energy injector. For the purpose of the ignition the said injector produces a first pulse shown at 6 and in consequence of that pulse the average pressure profile changes from the shape of curve 5 to that of curve 7 in FIG. 2.

The said breech-associated electrothermal propulsion energy injector is designed to deliver a second pulse shown at 8 in FIG. 2, which has the effect of maintaining the maximum pressure in the barrel for a longer period of time resulting in a profile shown by curve 9 in FIG. 2. This second pulse can also be injected by a barrel-associated injector.

A third electrothermal pulse shown at 10 in FIG. 2 has two functions: First to extend the period during which the maximum pressure is maintained so that the desired hypervelocity is achieved, and second, it injects more gas with a low molecular weight, i.e., high speed of sound, to serve as a more efficient pressure transfer medium to the projectile base. This pulse is the most energetic electrothermal pulse injected into the barrel and contains most of the electrothermal propulsion energy. The resulting overall pressure vs. time profile in the hybrid gun resulting from the three pulses is presented as curve 11 in FIG. 2.

The injection of the third pulse can be performed from:

a) the breech-associated injector
b) from one set of barrel-associated injectors
c) a series of barrel-associated injectors located along the barrel and delivering a series of pulses which together approximate the shape of curve 10.

One should bear in mind that the electrothermal energy injections represented as curves 6, 8 and 10 in FIG. 2, are only approximate shapes. The exact pulse shape and timing is determined for each specific gun, for each specific application and for each desired velocity.

It is evident that the correct sequential timing of the various gusts of activated working fluid injected into the gun by means of the breech-associated and barrel-associated electrothermal injectors and the duration of each such injection have to be suitably programmed and this is achieved by means of suitable electronic timing and switching devices known per se.

Figure 3:
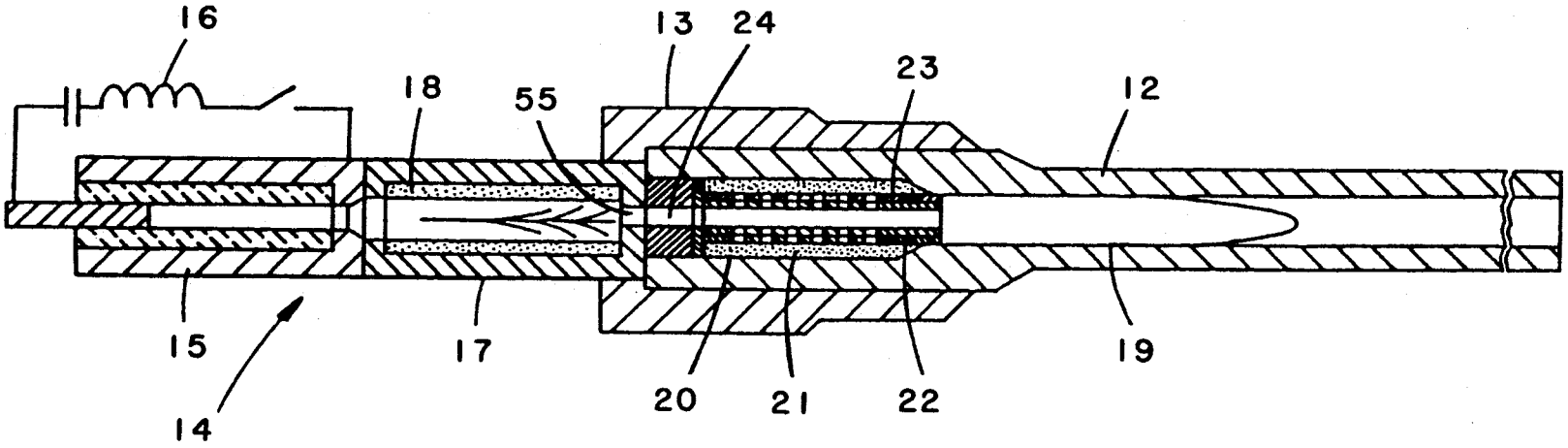
FIG. 3 is an axial section through a hybrid gun according to the invention with only one electrothermal propulsion energy injector.

The embodiment of the hybrid gun according to the invention shown in FIG. 3 comprises a barrel 12 with a breech 13 to the rear of which is mounted a breech-associated electrothermal propulsion energy injector 14 comprising a plasma jet generator 15 with an associated pulse-forming network (PFN) 16, and a tubular chamber 17 intermediary between the plasma jet generator 15 and breech 13, holding a working fluid 18.

Breech 13 is shown to hold a round of ammunition comprising a projectile 19 and associated cartridge 20 holding a suitably selected conventional chemical propellant 21. Cartridge 20 is fitted with a central perforated tube 22 lined with a plastic material ablative liner 23 having perforations overlying those of tube 22 and being of a material which upon heating, liberates a light gas. Cartridge 20 bears on a centrally bored boss 24 in the manner shown, the central bore of boss 24 being in alignment with a nozzle 25 of chamber 17.

The gun also comprises an electronic timing device (not shown) designed to activate in a suitably programmed fashion the PFN 16 of injector 14 so as to produce sequentially at least three plasma pulses. In operation, each time the plasma jet generator 15 of injector 14 produces a plasma pulse, a jet of activated working fluid 18 is injected via nozzle 25 and the the central bore of seat 24 into the central tube 22 of cartridge 20 and creates a small volume buffer zone near the base of projectile 19. On its way the injected hot working fluid ignites propellant 21.

The first working fluid gust provided by the first plasma pulse may have an approximate flow profile such as profile 6 in FIG. 2. There then follows a second plasma pulse which generates a second gust of working fluid having, for example a flow profile such as the profile of pulse 8 in FIG. 2, and in a similar way a third plasma pulse generates a third working fluid gust with a flow profile approximately similar to that of pulse 10 in FIG. 2.

By the combined effect resulting from expansion of the gases from the the combusting chemical propellant 21 and the first two gusts of activated working fluid injected by injector 14 and accumulating near the base of projectile 19, the latter begins to move along the barrel and at a suitable timing there then follows the third working fluid injection. As a result of the effects resulting from the interaction of the three gusts of activated fluid from injector 14 with the propellant gases, there forms a pressure profile similar to those of curve 3 in FIG. 1 and curve 11 in FIG. 2, and projectile 19 is ejected from the muzzle of barrel 12 at a high speed between 1500–4000 m/s.

Figure 4:
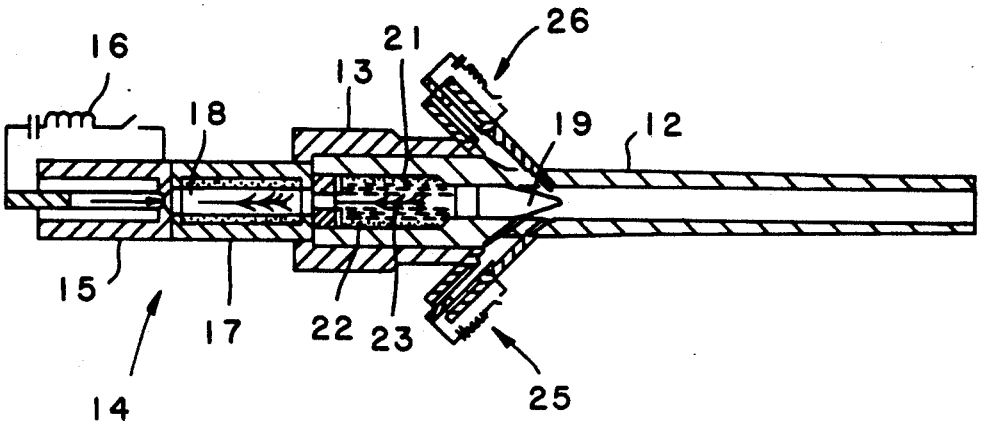
FIG. 4 is an axial section through a hybrid gun according to the invention with three electrothermal propulsion energy injectors.

The embodiment of a hybrid gun according to the invention shown in FIG. 4 comprises in addition to the breech-associated electrothermal propulsion energy injector also two barrel-associated injectors. In FIG. 4 components corresponding to those of the embodiment of FIG. 3 are marked by the same reference numerals. As shown, this embodiment comprises close to the breech 13 a pair of barrel-associated electrothermal propulsion energy injectors 25 and 26 being arrange din a specific configuration and symmetrical with respect to the axis of the barrel 12. In this embodiment the electronic timing devices (not shown) are designed to activate in a suitably programmed fashion the PFN of the various injectors and appropriate fiberoptics or other sensors are provided to detect the location and speed of the travelling projectile.

Similar as in the embodiment of FIG. 3, the first two working fluid pulses are produced by the barrel-associated electrothermal energy injector 14. However, as distinct from that embodiment, in the present embodiment the third, booster working fluid pulse is produced by the barrel-associated electrothermal propulsion energy injectors 25 and 26 which, at a suitable timing inject simultaneously activated working fluid into the barrel.

Figure 5:
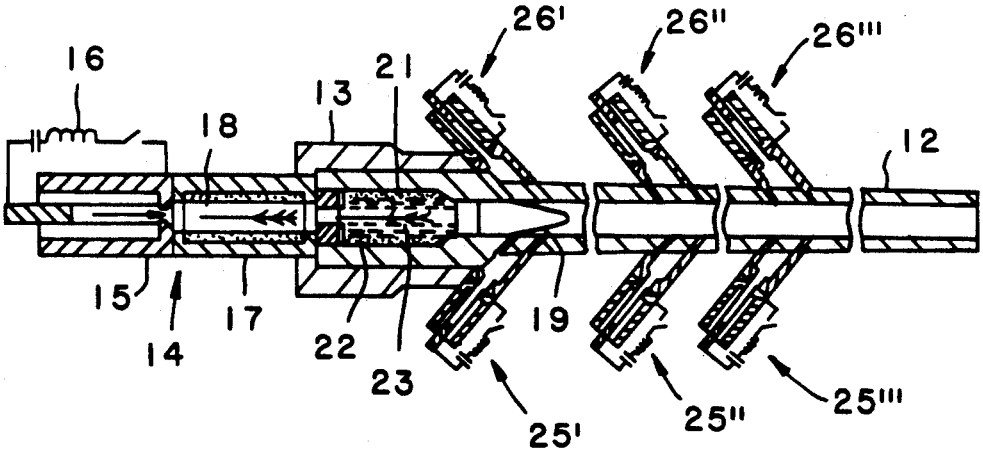
FIG. 5 is an axial section through a hybrid gun according to the invention with several electrothermal energy injectors along the barrel.

The embodiment of a hybrid gun according to the invention shown in FIG. 5 is essentially similar to that of FIG. 4 and corresponding components are again marked by the same reference numerals. In this embodiment the single pair of barrel-associated electrothermal injectors 25 and 26 of FIG. 4 is replaced by several such pairs such as 25', 26'; 25'', 26''; and 25''', 26''' and if desired, there may be more. The operation of this embodiment is essentially similar to that of FIG. 4 except that in this case several pairs of injectors will be activated successively as the projectile travels within the barrel. A plurality of injectors has the advantage of enabling a more efficient tailoring of the electrothermal pulse shapes and of affording an improved subsistance of the light gas buffer zone behind the advancing projectile.

Figure 6:
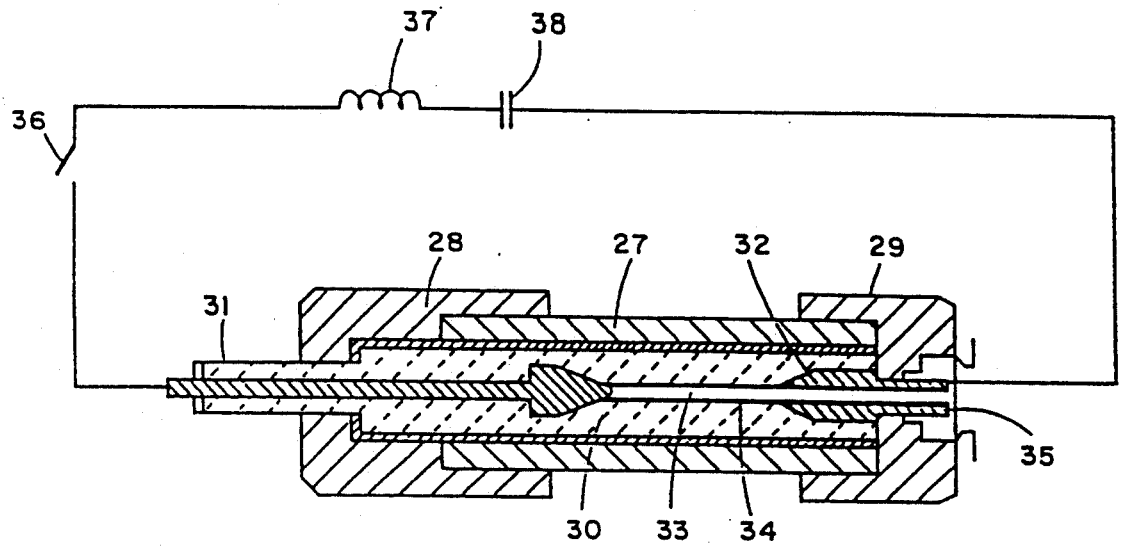
FIG. 6 is an axial section through a plasma jet generator forming part of an electrothermal propulsion energy injector in a hybrid gun according to the invention.

The breech associated plasma jet generator 15 of FIGS. 3 and 4 is more closely shown in FIG. 6. As can be seen, it comprises a high strength steel housing 27 fitted with holding caps 28 and 29 capable of withstanding high pressure. Housing 27 holds a cylindrical body of high mechanical strength insulating material made of composites 30 and holding a cathode 31 and an anode 32.

A capillary tube 33 made of ablative plastic material 34 links cathode 31 with the anode 32 which latter is centrally bored and comprises an integral, outwardly screw-threaded tubular portion 35 whose central bore is in full alignment with bore 34 and forms an exit nozzle for the plasma. The plastic material liner 34 is ablated by the electrical current to produce the plasma.

The plasma injector is connected to an electrical pulse forming network (PFN) indicated at 16 in FIGS. 3, 4 and 5 and which, for the sake of simplicity, is represented here by a switch 36, an inductor 37 and a capacitor 38. A prime power electrical power supply is used to load electrical energy into the PFN.

Figure 7:
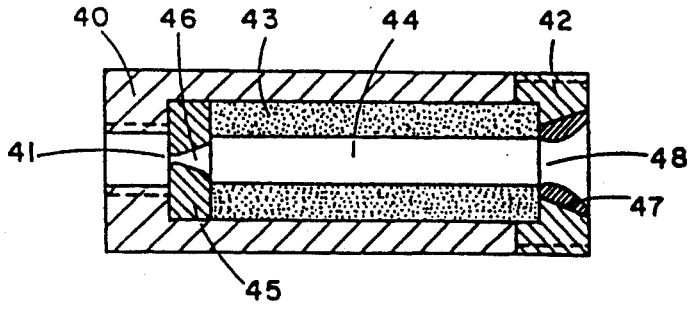
FIG. 7 is an axial section through a working fluid holding chamber in an electrothermal propulsion energy injector of a hybrid gun according to the invention.

Each electrothermal injector also comprises a tubular chamber holding a working fluid such as chamber 17 in FIGS. 3, 4 and 5 and such chamber is more closely shown in FIG. 7. It comprises a body 40 made of high strength material and having a screw threaded inlet nozzle 41 adapted for mounting on the outwardly screw-threaded injection nozzle 35 of the plasma jet generator of FIG. 6. The body 40 is further fitted with a connector 42 adapted for connection to the breech 13 of the gun shown in any of FIGS. 3, 4 and 5.

Body 40 holds a liner 43 which upon the passage of a plasma jet is adapted to liberate a working fluid. Liner 43 may, for example, be in the form of an absorbent material soaked with working fluid or alternatively in the form of a gel or the whole space might be filled with a light gas forming substance.

The tubular chamber 44 of body 40 serves as the mixing chamber in which the plasma jet arriving from the generator of FIG. 6 mixes with working fluid in said chamber.

Adjacent to the inlet nozzle 41 there is an annular member 45 of high temperature resisting material with a conical aperture 46, and a second annular body 47 of high temperature resisting material near the opposite end and having a conical aperture 48 serves as exit nozzle for the activated working fluid.

We claim:

1. A gun having a barrel and a breech for launching a projectile with the combustion gases of a solid chemical propellant, comprising a barrel, a breech connected to said barrel, said breech in operation containing a cartridge containing a round of ammunition consisting of a single charge combustible solid chemical propellant and a projectile, electrothermal energy injection means comprising a breech-associated plasma injector means located to the rear of the breech comprising a plasma jet generator, and a chamber arranged between said plasma jet generator and said breech, said chamber containing a light working fluid having a molecular weight not exceeding that of said chemical propellant;

electric pulse generating means for the successive energization of said plasma injector means, said electric pulse generating means providing at least two plasma pulses for each round of ammunition, each plasma pulse causing a jet of energized gas to be injected into said breech and impinge said single charge of combustible solid chemical propellant, and means for providing an injection of energized gas into said barrel after at least one of said plasma pulses has been injected into said breech, said electrothermal energy injection means providing sufficient jets of energized gas to ignite said combustible solid chemical propellant and to accelerate said projectile, such that said projectile is launched by the combined propulsion of said combustible solid chemical propellant and said energized gas.

2. A gun according to claim 1, wherein said means for providing a further injection of energized gas into said barrel comprises at least one barrel-associated plasma injector and intermediary thereof and the barrel an aligned tubular chamber having a nozzle opening into the barrel and holding a working fluid having a molecular weight not exceeding that of said chemical propellant.

3. A gun according to claim 2, wherein the barrel-associated plasma injects and aligned tubular chambers are arranged pairwise with each pair being mounted on the barrel in axi-symmetrical configuration with respect to the longitudinal axis of the barrel.

4. A gun according to claim 3 comprising a single pair of plasma injectors and aligned tubular chambers.

5. A gun according to claim 4 comprising several pairs of plasma injectors and aligned tubular chambers.

6. A method of converting a conventional gun into a hybrid gun comprising providing at the rear of the breech an electrothermal propulsion energy injector comprising in mutual alignment a plasma jet injector in association with electric pulse generating means and a tubular chamber fitted with nozzle and holding a working fluid having a molecular weight not exceeding that of a chemical propellant of the ammunition designated for launching by the gun, providing electric pulse generating means in conjunction with said electrothermal energy injection means such that at least two plasma pulses are generated for each round of ammunition, said at least two plasma pulses causing jets of energized gas to be injected into said breech and in proximity to a single charge of solid conventional chemical propellant, and providing an injection of energized gas into said barrel after said at least two plasma pulses have been injected into said breech, and providing sufficient jets of energized gas to ignite said combustible solid chemical propellant and to accelerate a projectile, such that said projectile is launched by the combined propulsion of said combustible solid chemical propellant and said energized gas.

7. The method of claim 6 comprising in addition replacing an existing barrel by a barrel fitted with at least one plasma injector in association with pulse generating means and a tubular chamber fitted with a nozzle and holding a working fluid having a molecular weight not exceeding that of the said chemical propellant.

8. A hybrid gun obtained by conversion of a conventional gun by the method of claim 6.

9. A hybrid gun obtained by conversion of a conventional gun by the method of claim 7.

* * * * *